United States Patent [19]

Kern

[11] 3,951,874

[45] Apr. 20, 1976

[54] METHOD FOR PREPARING ELECTRON EMISSIVE COATINGS

[75] Inventor: Edmund R. Kern, Hampton, N.H.

[73] Assignee: International Telephone and Telegraph Corporation, Nutley, N.J.

[22] Filed: July 10, 1974

[21] Appl. No.: 487,082

[52] U.S. Cl. ..... 252/521; 252/500; 423/593

[51] Int. Cl.[2] ..... H01B 1/06

[58] Field of Search ..... 252/521; 423/593; 117/223

[56] References Cited

UNITED STATES PATENTS

| | | | |
|---|---|---|---|
| 2,724,070 | 11/1955 | Heine et al. | 252/521 X |
| 2,985,548 | 5/1961 | Blickwedel et al. | 117/223 X |
| 3,464,785 | 9/1969 | Galasso | 423/598 |
| 3,718,831 | 2/1973 | Butter et al. | 313/346 R |
| 3,755,553 | 8/1973 | Kutolin et al. | 423/593 X |
| 3,758,809 | 9/1973 | Menelly et al. | 313/346 R |
| 3,766,423 | 10/1973 | Menelly | 313/311 |
| 3,798,492 | 3/1974 | Menelly | 313/346 R |
| 3,837,909 | 9/1974 | Menelly | 117/224 |
| 3,842,469 | 10/1974 | Menelly | 29/25.11 |

OTHER PUBLICATIONS

Journal of Physical Chemistry 67, 533–534 (1963).

*Primary Examiner*—Benjamin R. Padgett
*Assistant Examiner*—E. Suzanne Parr
*Attorney, Agent, or Firm*—John T. O'Halloran; Menotti J. Lombardi, Jr.; Richard A. Menelly

[57] ABSTRACT

An improved emissive tantalate coating for fluorescent lamps provides long operational lamp life and low lamp end discoloration. The emissive tantalate has the composition $Ba_5Ca_4Ta_2O_{14}$ and is applied in powder form to standard fluorescent lamp electrodes.

2 Claims, 5 Drawing Figures

METHOD FOR PREPARING ELECTRON EMISSIVE COATINGS

BACKGROUND OF THE INVENTION

Fluorescent lamp operating life has heretofore been limited to the amount of electron emissive coating available on the fluorscent lamp electrodes. When the emissive coating has been completely used up during lamp operation the lamp is no longer able to start and is considered defective and must hence be discarded. The discovery that heavy emissive coating quantities can be applied to the fluorescent lamp electrodes by the use of a barium tantalate emissive coating having the formulation $5BaO. Ta_2O_5$ has therefore produced fluorescent lamps capable of operating lifetimes far in excess of lamps having the standard triple carbonate coatings of the prior art.

The barium tantalate having the formulation described within the copending application entitled "Emissive Coating for Electrodes" - E. R. Kern-4 assigned to the assignee of the instant invention has greatly extended the operating lamp life of fluorscent lamps but deters from the cosmetic appearance of the lamp since it causes the premature formation of the unsightly end discoloration that is characteristic of lamps that are burnt for long periods of time. The exact nature of the end discoloration on fluorescent lamps is not fully understood but is believed to comprise a combination of the barium metal deposited from the emissive coating and oxides of mercury (present in the lamp envelope) that accumulate and react on the inner lamp envelope surface in the vicinity of the electrodes after a few hundred hours of operation. The early formation of the unsightly end discoloration of the barium tantalate emissive coating can be somewhat deterred by the addition of a quantity of calcium carbonate to the barium tantalate coating suspension. The improvement in the reduction of end discoloration with the addition of the calcium carbonate although helpful is not usually sufficient to bring the lamps containing the barium tantalate emissive coating within acceptable fluorescent lamp quality standards. The purpose of this disclosure therefore is to describe an improved emissive tantalate compound that has the aforementioned properties of extended fluorescent lamp life but improves the fluorescent lamp quality by eliminating the early formation of lamp end discoloration.

SUMMARY OF THE INVENTION

Mixed barium-calcium tantalates having a composition range of $Ba_xCa_yTa_2O_z$ is formed where $x$ has the value from 2 to 7, y has the value 1 to 8 and $z$ has the value from 5 to 20. The mixed barium-calcium tantalates produce stable tertiary compounds that are capable of good thermionic emission when applied to fluorescent lamp electrodes with a low formation rate for end discoloration.

DESCRIPTION OF THE PREFERRED EMBODIMENT

Figure 1:
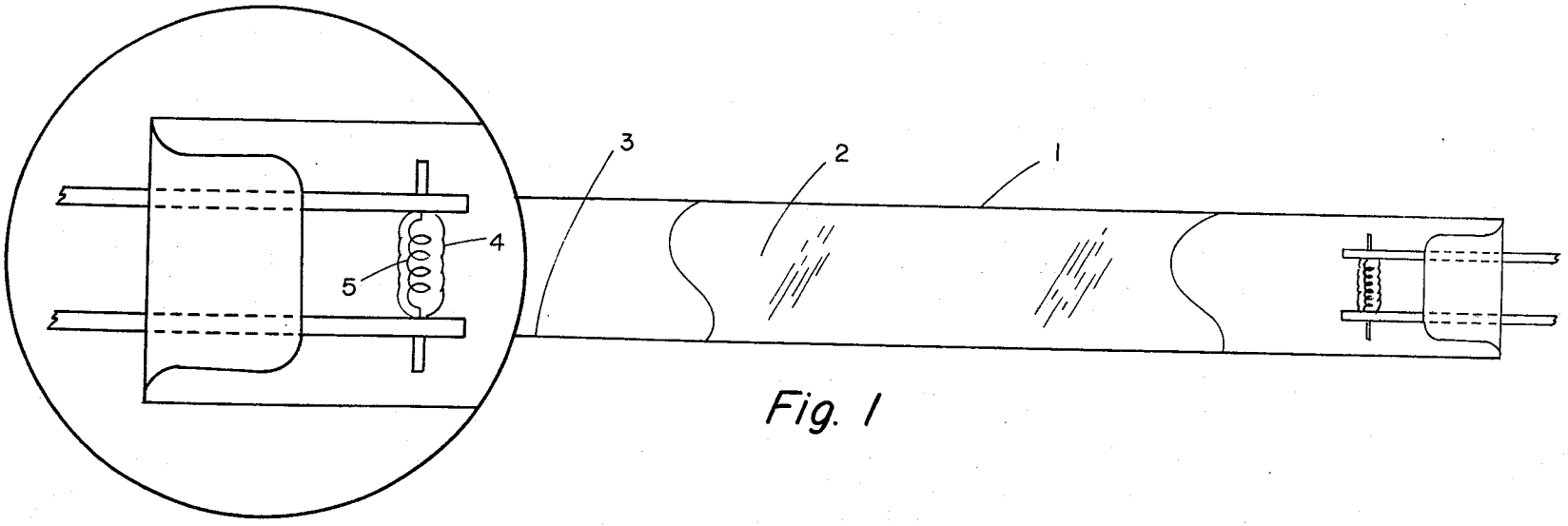
FIG. 1 is a fluorescent lamp with the phosphor coating removed to show the electrode structure.

FIG. 1 shows a typical fluorescent lamp 1 consisting of a glass envelope containing an inert coating of fluorescent phosphor 2 and a pair of electrodes 5 sealed at either end. The envelope contains a mixture of a few microns of mercury and a few milimeters of an inert gas typically argon. The discharge occurs by applying a voltage usually in the order of several hundred volts across the aforementioned electrodes sufficient to ionize the gas and cause the passage of electrons therethrough. In order to facilitate the occurrence of the discharge an electron emissive coating 4 is generally applied to the fluorescent coils 5 which comprise the electrodes and consist generally of a few turns of a refractory metal.

Figure 4:
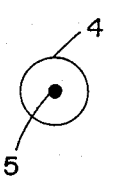
FIG. 4 is a cross-sectional view of the coil of FIG. 3.
Figure 3:
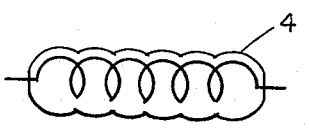
FIG. 3 is the coil of FIG. 2 with an emissive coating on the surface.
Figure 2:
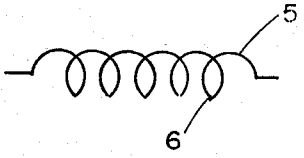
FIG. 2 is typical fluorescent electrode coil.

FIG. 2 shows an enlarged view of the coil 5 of FIG. 1 having a number of turns 6. The presence of the turns 6 performs a 2-fold function namely: to increase the coil resistance in a short linear extent; and, to provide a large surface area in order to facilitate the adhesion between the emissive coating 4 and the coil 5. FIG. 3 shows an enlarged emissive coated coil 5 where the emissive coating 4 covers the body of the coil. FIG. 4 shows a cross-section of the emissive coating coil showing the relationship in the relative cross-sectional areas between the emissive coating 4 and the coil substrate 5.

A typical fluorescent lamp chosen for the purpose of this embodiment consisting of an eight foot long high output (H.O.) type fluorescent lamp having a rated lamp operating current of 800 miliamperes. This lamp was particularly chosen in order to show the improved emissive tantalate coating having lower end discoloration by the addition of calcium to form the mixed barium-calcium tantaltes disclosed herein. In the aforementioned application entitled "Emissive Coating for Electrodes" - E. R. Kern- 4, incorporated by reference within this disclosure there is disclosed a novel barium tantalate emissive coating which provided heavy emissive coating weights to fluorescent lamps and resulted in long lamp operating life. It was also disclosed therein that the addition of calcium carbonate or calcium oxide to the barium tantalate formulation improved the lamp appearance by deterring to some extent the formation of unsightly end discoloration. By forming a barium-calcium tantalate compound as an electron emissive coating the formation rate of the end discoloration is substantially decreased with no deleterious effect on the good thermionic emission properties with the barium tantalate and the resulting long operating lamp life.

The mixed barium tantalate was formed by taking a one pound mixture having the relative composition of 5 mols barium carbonate, 4 mols calcium carbonate, 1 mol of tantalum pentoxide, and milling the mixture in a suspension of methyl alcohol in order to ensure a homogeneous suspension. After milling for several hours the suspension was removed from the mill and the methyl alcohol removed by first separating the powder by sedimentation and decanting the alcohol later followed by evaporating the alcohol by gentle heating. The result was the pressed into ¼ inches diameter slugs on a pellet press for ease in handling and to provide good thermal properties to the material during the subsequent heating process. The slugs were then heated in an alumina crucible for one hour at 800°C and then the temperature was increased to 1200°C for two hours to complete the formation of the tantalate reaction. After cooling the slugs were removed and motar-ground to the equivalence of a few microns particle size distribution. As is usual in the fluorescent lamp industry, the powder was then added to a solution of nitrocellulose and butyl acetate in order to provide an adhesive carrier for the coating and to facilitate application to the lamp electrodes by the usual method of dip application. Zirconium oxide can also be added to the barium carbonate tantalate mix in amounts of 5 to 12 percent. The barium-calcium tantalate powder can also be applied by wetting with a solvent without using a binder and has good adherence properties. This could save time and material if the binder is not used.

A statistical quantity of H.O. type lamps were processed having the mixed barium-calcium tantalate composition petrographically and analytically determined to mainly have the formulation $Ba_5Ca_4Ta_2\ O_{28}$. The lamps were then subjected to life test by operating the lamps on a three hour on-cycle and a 20 minute off-cycle which is the fluorescent lamp industry standard for lamp life determination and for the measurement of the formation rate for lamp end discoloration. The lamps having the mixture barium-calcium tantalate were operated in comparison with lamps containing the barium tantalate as described within the aforementioned referenced application designated Kern-4. The results show that the mixed barium-calcium tantalate greatly improved the fluorescent lamp quality in view of the decreased formation rate for lamp end discoloration without subtracting from the long life obtained with the heavy barium tantalate coatings.

Figure 5:
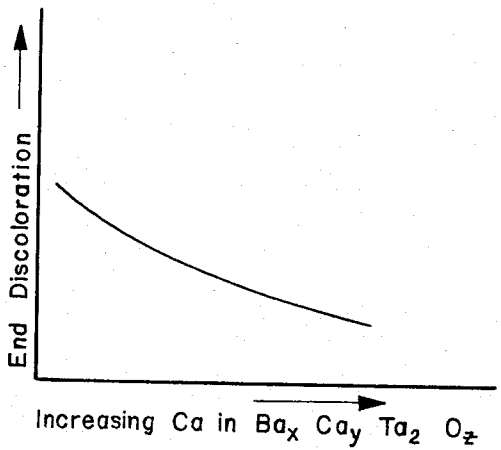
FIG. 5 is a plot of the relationship between end discoloration and increasing calcium content of the emissive alkaline earth tantalate of this invention.

Subsequent ranges of barium-calcium tantalate were also evaluated in lamps where the barium content was varied from 2 to 7 mols, the calcium from 1 to 8 mols and the oxygen from 5 to 20 mols and wherein the tantalum was, as much as possible, kept at 2 mols. FIG. 5 shows a plot of end discoloration versus the relative calcium content in the barium-calcium tantalate. End discoloration is shown as an increasing function on the *y* axis versus the increasing calcium content along the *x* axis. The beneficial decrease in end discoloration therefore was found to occur over the calcium compositional range wherein the barium was only slightly greater than the calcium and incrased calcium content beyond equimolar qualities of barium and calcium provided no further decrease in the measured end discoloration.

The barium-calcium tantalates over the aforementioned range showed the same air-stable properties as the barium tantalate and also showed the increased coating weights, increased lift along with the added benefit of a lower rate of the formation of end discoloration.

This disclosure describes the use of mixed tantalate electron emissive coatings for improved fluorescent lamp operating life but is not intended in any way to be limited to this application. Electron emissive coatings currently being used for fluorescent lamp devices also find application in other devices such as lasers; for example, high pressure lamps, and various electron tube types.

The mixed emissive tantalates disclosed herein therefore will provide good operating characteristics beyond the scope of the fluorescent lamp embodiment described herein.

What is claimed is:

1. The method for preparing electron emissive coatings for electrical gas discharge devices comprising the following steps:

combining 5 mols of $Ba_5Ta_2O_{10}$ with 4 mols $CaCO_3$;

milling the mixture in a suspension of methyl alcohol for obtaining a homogeneous suspension therein; and drying the suspension and heating for one hour at 800°C and for two hours at 1200°C in order to form the alkaline earth tantalate.

2. A method for preparing electron emissive coating for electrical gas discharge devices comprising the following steps:

combining 5 mols of $Ba_5Ta_2O_{10}$ with 4 mols CaO;

milling the mixture in a suspension of methyl alcohol for obtaining a homogeneous suspension therein;

drying the suspension and heating for one hour at 800°C and for two hours at 1200°C in order to form the alkaline earth tantalate; and cooling and grinding to a powder form and suspending in a solution of nitrocellulose and butyl acetate solvent in order to provide a coating suspension.

* * * * *